US007766077B2

(12) United States Patent
Masters et al.

(10) Patent No.: US 7,766,077 B2
(45) Date of Patent: Aug. 3, 2010

(54) SELF-CONTAINED MODULAR HEATER

(75) Inventors: W. James Masters, Trophy Club, TX (US); Douglas W. Fugate, Flower Mound, TX (US); Edwin E. Wilson, Grand Prairie, TX (US); John T. Johnson, III, Arlington, TX (US); W. Jason Masters, Grapevine, TX (US)

(73) Assignee: OmniTherm, Inc., Fort Worth, TX (US)

( * ) Notice: Subject to any disclaimer, the term of this patent is extended or adjusted under 35 U.S.C. 154(b) by 345 days.

(21) Appl. No.: 11/697,739

(22) Filed: Apr. 8, 2007

(65) Prior Publication Data

US 2007/0261823 A1 Nov. 15, 2007

Related U.S. Application Data

(63) Continuation-in-part of application No. 11/398,828, filed on Apr. 5, 2006.

(60) Provisional application No. 60/668,541, filed on Apr. 5, 2005.

(51) Int. Cl.
*F28B 1/00* (2006.01)

(52) U.S. Cl. ..... 165/200; 210/748.01; 210/739; 210/600; 60/645; 60/670

(58) Field of Classification Search ..... 210/748, 210/739, 600; 60/645, 670; 165/110
See application file for complete search history.

(56) References Cited

U.S. PATENT DOCUMENTS

| | | | | |
|---|---|---|---|---|
| 6,182,453 | B1 * | 2/2001 | Forsberg | 62/125 |
| 2002/0050478 | A1 * | 5/2002 | Talbert et al. | 210/742 |
| 2003/0070430 | A1 * | 4/2003 | Beckius et al. | 60/645 |

FOREIGN PATENT DOCUMENTS

WO WO 9964112 A1 * 12/1999

OTHER PUBLICATIONS

Island City, LLC specification for Dynamic Engine Heater, model A2R1163 VN.

* cited by examiner

*Primary Examiner*—Walter D Griffin
*Assistant Examiner*—Cameron J Allen
(74) *Attorney, Agent, or Firm*—Chalker Flores, LLP; Daniel J. Chalker; Edwin S. Flores

(57) ABSTRACT

The present invention provides a system, method and apparatus for heating a fluid without a flame. The modular heater (apparatus) that includes an enclosure, a dynamic heat generator disposed within the enclosure, an electric motor disposed within the enclosure, a first fluid connector attached to the enclosure, a second fluid connector attached to the enclosure and an electrical connector attached to the enclosure. The electric motor drives the dynamic heat generator to heat the fluid to a specified temperature without a flame. The first fluid connector connects the dynamic heat generator to a fluid source. The second fluid connector connects the dynamic heat generator to a fluid storage. The electrical connector connects the electric motor to a power source.

34 Claims, 9 Drawing Sheets

SELF-CONTAINED MODULAR HEATER

PRIORITY CLAIM

This patent application is a continuation-in-part application of U.S. patent application Ser. No. 11/398,828 filed on Apr. 5, 2006 and entitled "System and Method for Producing Hot Water Without a Flame" which is a non-provisional application of U.S. provisional patent application 60/668,541 filed on Apr. 5, 2005 and entitled "Flameless Hot Water System and Method," all of which are hereby incorporated by reference in its entirety.

FIELD OF THE INVENTION

The present invention relates generally to the field of heating liquids and, more particularly, to a self-contained modular heater to purify water, heat liquids or provide auxiliary heat for vehicles.

BACKGROUND OF THE INVENTION

One of the most pressing needs throughout the world is drinkable water. An untold number of humans die every year because the water they consume is contaminated. In some areas, people are forced to spend a great deal of time manually hauling water from a distant source to their homes and villages rather than taking the risk of drinking untested water that might be nearby.

There are many methods of purifying water. One of the most common is reverse osmosis (RO). This process has been around for a long time, but it has its drawbacks. Although RO systems can be inexpensive, there is an ongoing maintenance requirement of filter replacement. Filters in RO systems can become clogged and/or damaged by constant exposure to the water source being purified. Cost and availability of replacement filters and the skill level to perform this maintenance requirement can present a problem.

Another method of water purification includes adding chemicals to the water to kill pathogens. Generally, chemical applications are used for situations where small amounts of water need purification. Although effective when the proper concentrations of chemicals are used, it is difficult to always measure the proper amounts. In addition, this system of purification does not address problems with heavy metals that may be present in water.

Boiling water is another way of killing pathogens in water. Unfortunately, in many parts of the world where contaminated water is a major problem, the availability of materials to heat water, such as wood, does not exist.

In particular areas or industries, hot water and/or steam may be needed, but it may be critical that no open flames be used to heat the water. One such industry is the oil field service industry. In many geographical regions oil reservoirs are found to contain high concentrations of paraffin, a waxy crystalline hydrocarbon. This substance, while commercially useful in the manufacture of coatings, sealants, candles, rubber compounding, pharmaceuticals and cosmetics, can present a problem with regard to the production of oil. Paraffin suspended in the crude oil tends to clog perforations in the oil well's production string and slows the flow of crude oil to the surface.

Several technologies have been in use for many years to minimize the detrimental effects of paraffin. Among these is injecting hot water, steam or chemical solvents into the well to clean out the wells perforations by liquefying the paraffin either by heating it above its melting point or chemically changing its composition. While effective, all of these have their shortcomings.

When the hot water method is employed, water must be transported to the well site then heated in a LPG or diesel fired boiler mounted either on a truck chassis or trailer. Availability of water at the well site is a common problem, and unsafe conditions exist when an open flame, like those used to heat water or crude in the boiler tanks, is positioned near the wellhead where there may be a high concentration of natural gas in the atmosphere.

The steam method usually entails the building of a power plant utilizing the field's natural gas to produce electricity and piping the waste steam to various wellheads for injection. While this eliminates the open flame close to the wellhead, it can involve a large capital expenditure that may become economically viable only when there is a large concentration of wells in a relatively small area. Piping steam to isolated outlying wells is sometimes not viable because too much heat may be lost before the steam gets to the wells. This may cause only distilled water to be delivered to the wellhead.

The chemical solvent method locates a container of solvent near the wellhead, and then injects it down hole with each stroke of the well's pumping unit. While this method eliminates open flames near the wellhead and does not require large capital expenditures, it does add substantial cost to the operation. The chemicals are expensive, costs associated with the transportation and handling of hazardous chemicals is expensive, and the addition of these chemicals to the crude oil makes the refining process more expensive.

Under normal ambient conditions, an engine's rejected heat is sufficient to maintain vehicle, engine, crew and cargo temperatures. However, defense and specialized commercial vehicles must operate in temperatures ranging from +150° F. to −50° F. in Arctic regions. In cold weather environments such as these, difficulties arise when starting diesel engines and maintaining suitable engine, crew and cargo temperatures. Past and present heating methods include gasoline and diesel fired, portable (swing fire), as well as fixed crew and engine block heaters. Fuel fired heaters suffer from high maintenance, short operating life, high fuel consumption, corrosion, fire hazard, bulk high temperature signature, noxious exhaust, noise and are often difficult to start, particularly when operated on diesel fuel. Engine starting aids including glow plugs and ether injectors can improve starting performance but they are unnecessary when engines are adequately preheated.

Modern engines are increasing efficient and converting fuel into power and reducing exhaust emissions. With this improved efficiency, engines reject less heat through their water jackets and are increasingly subject to poor performance at low temperatures. In the oilfield, this exhibits itself in clouds of smoke, consisting of unburned fuel particles due to inadequate fuel combustion. As a result, there exists a need for a compact, lightweight, fast acting, efficient vehicle heater that does not require separate fuel or air for combustion or that generate additional exhaust to preheat and maintain engine, crew and cargo temperature in cold weather.

SUMMARY OF THE INVENTION

One embodiment of the present invention provides a compact, lightweight, fast acting, efficient vehicle heater that does not require separate fuel or air for combustion or that generate additional exhaust to preheat and maintain engine, crew and cargo temperature in cold weather. The modular heater of the present invention maintains adequate coolant temperatures under ambient temperatures conditions where the engine's rejected heat is insufficient to maintain the engine's proper operating temperature and allows the engines to operate at normal operating temperatures at all times, even in the Arctic conditions. The present invention can be used in many applications in some of the harshest climates in the world where the heaters are required to be operated around the clock either mechanically, electrically and hydraulically where no adjustments are a must and no maintenance is a requirement. In addition, the modular heater of the present invention can be used to heat fluid to produce electricity, provide radiant heat, provide drinking water, melt paraffin in an oil well, produce steam or produce steam to reform a petroleum fuel to produce hydrogen for use in a fuel cell.

More specifically, the present invention provides a method for heating a fluid without a flame by providing a power source for an electric motor disposed within a modular heater, pumping the fluid to a dynamic heat generator disposed within the modular heater, heating the fluid to a specified temperature without the flame using the dynamic heat generator driven by the electric motor and providing the heated fluid to an output.

In addition, the present invention provides a system for heating a fluid to at least a specified temperature without a flame. The system includes a modular heater, a power source electrically connected to an electric motor and a pump connected to a dynamic heat generator. The modular heater includes the dynamic heat generator driven by the electric motor disposed within an enclosure. The dynamic heat generator is driven by the electric motor to heat the fluid to a least the specified temperature without a flame.

Moreover, the present invention provides a modular heater that includes an enclosure, a dynamic heat generator disposed within the enclosure, an electric motor disposed within the enclosure, a first fluid connector attached to the enclosure, a second fluid connector attached to the enclosure and an electrical connector attached to the enclosure. The electric motor drives the dynamic heat generator to heat the fluid to a specified temperature without a flame. The first fluid connector connects the dynamic heat generator to a fluid source. The second fluid connector connects the dynamic heat generator to a fluid storage. The electrical connector connects the electric motor to a power source.

Other technical advantages will be readily apparent to one skilled in the art from the following figures, descriptions and claims. Moreover, while specific advantages have been enumerated above, various embodiments may include all, some or none of the enumerated advantages.

BRIEF DESCRIPTION OF THE DRAWINGS

The above and further advantages of the invention may be better understood by referring to the following description in conjunction with the accompanying drawings, in which.

DETAILED DESCRIPTION OF THE INVENTION

Figure 1:
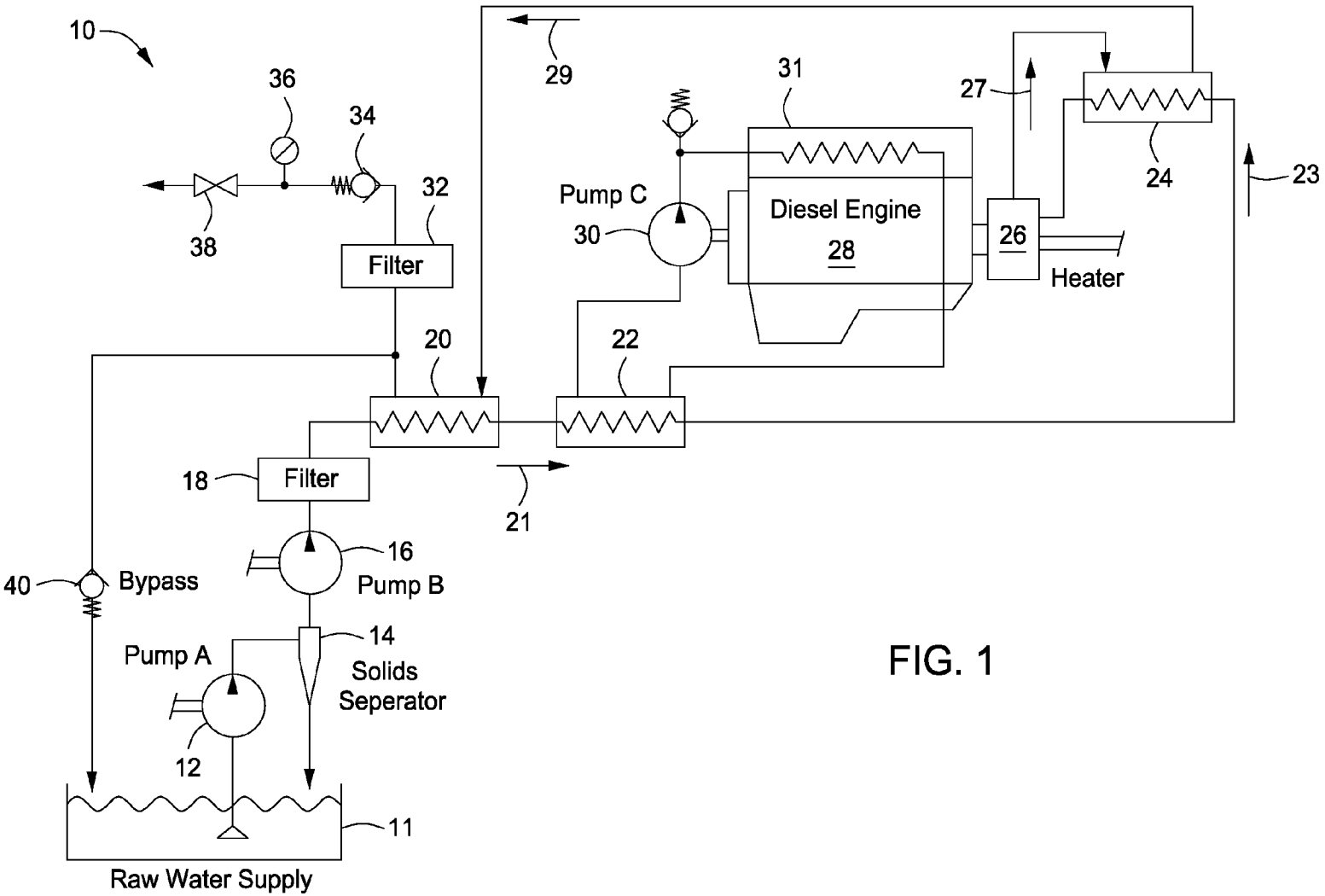
FIG. 1 illustrates a flameless hot water system for killing pathogens and other contaminants, in accordance with a particular embodiment.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention. The discussion herein relates primarily to heating water, but it will be understood that the concepts of the present invention are applicable to any system and method for heating liquids without using open flames for killing pathogens in water, distilling water, producing radiant heat, melting paraffin in oil wells, and steam reforming of petroleum fuels for the production of hydrogen for use in fuel cells.

One embodiment of the present invention provides a compact, lightweight, fast acting, efficient vehicle heater that does not require separate fuel or air for combustion or that generate additional exhaust to preheat and maintain engine, crew and cargo temperature in cold weather. The modular heater of the present invention maintains adequate coolant temperatures under ambient temperatures conditions where the engine's rejected heat is insufficient to maintain the engine's proper operating temperature and allows the engines to operate at normal operating temperatures at all times, even in the Arctic conditions. The present invention can be used in many applications in some of the harshest climates in the world where the heaters are required to be operated around the clock either mechanically, electrically and hydraulically where no adjustments are a must and no maintenance is a requirement. In addition, the modular heater of the present invention can be used to heat fluid to produce electricity, provide radiant heat, provide drinking water, melt paraffin in an oil well, produce steam or produce steam to reform a petroleum fuel to produce hydrogen for use in a fuel cell.

In another embodiment, the ability to heat water above 212 degrees Fahrenheit, to kill pathogens without the need of an open flame, makes this system adaptable to all types of locations and environments. In addition, particular embodiments can be adapted for the distillation of salt water. Particular embodiments are capable of performing additional applications for hot water and/or steam and at the same time are capable of reducing safety issues that are associated with other applications.

More specifically, the present invention provides a method for heating water to at least a specified temperature without a flame by providing a source of water and a prime mover, pumping water from the source of water into one or more heat exchangers, pre-heating the water using the one or more heat exchangers, heating the pre-heated water to at least the specified temperature without a flame using a dynamic heat generator driven by the prime mover, using the heated water in the one or more heat exchangers to pre-heat the water and providing the heated water to an output. The dynamic heat generator may be similar or identical to devices provided by Island City, LLC and typically includes a stationary housing having an input, an output, and a first set of radial vanes within the stationary housing, and a rotor disposed within the stationary housing having a second set of radial vanes. The specified temperature can be greater than or equal to 212 degrees Fahrenheit, greater than a temperature required to kill pathogens within the water, greater than or equal to 250 degrees Fahrenheit, greater than or equal to 300 degrees Fahrenheit, greater than or equal to a temperature required to desalinate saltwater, greater than or equal to a temperature required to melt paraffin, greater than or equal to a temperature required to create steam, or any other desired temperature.

The method may also include steps to: (1) substantially remove solids from the water using one or more filters, one or more screens, a hydrocyclone or a combination thereof, (2) filtering the water before pre-heating the water; (3) filtering the heated water before providing the heated water to the output; (4) controlling the specified temperature by adjusting a flow rate of the water through the dynamic heat generator; (5) storing the heated water; or (6) circulating the heated water. The heated water can then be used to produce electricity, provide radiant heat, provide drinking water, melt paraffin in an oil well, produce steam, produce steam to reform a petroleum fuel to produce hydrogen for use in a fuel cell, or any other use that requires hot water.

As will be shown in particular embodiments described below, water is pumped from its source using a diaphragm pump or mechanical pump that can be adjusted to control the flow of intake. If necessary, a hydrocyclone can be placed between the water source and the dynamic heat generator to remove solid debris down to approximately three microns. This prevents larger debris from entering the dynamic heat generator. The water is then run through the inside of a heat transfer unit that has the engine block water running on the outside of the unit. This step increases the efficiency of the process by preheating the water. The preheated water then flows to the dynamic heat generator. Until the water reaches the desired temperature, it continues in a loop back to the water source. As the water temperature exceeds 212 degrees Fahrenheit or other specified temperature, a thermostat device opens and the non-contaminated water is released into a holding tank.

Particular embodiments can be trailer mounted or permanently placed and may be set up in remote areas or disaster locations where potable water is necessary for survival. One aspect of the system is a dynamic heat generator that, when coupled to a power source such as a small diesel engine or electrical motor, can produce in minutes a constant flow of water in excess of 212 degrees Fahrenheit. In some embodiments, no open flames or heating elements are required to heat water to this temperature or higher. In addition, the system has the ability to produce electricity for lighting, by adding a generator set to the system, and radiant heat for warming homes or buildings.

When salt water treatment is required, the water that has reached a temperature of 212 degrees Fahrenheit may be run through a hydrocyclone causing a vacuum which then flashes the water to steam. At that point, the salt is separated from the water and the concentrated salt brine falls through the bottom of the hydrocyclone while the pure steam escapes and flows through a heat exchanger that condenses it back to a liquid form.

In addition, the present invention provides a system for heating water to at least a specified temperature without a flame using a prime mover, a pump, a dynamic heat generator and one or more heat exchangers. The dynamic heat generator is driven by the prime mover to heat the water to a least the specified temperature without a flame. The one or more heat exchangers are connected to the pump and the dynamic heat generator such that the heated water from the dynamic heat generator is provided to an output and is used to pre-heat the water from the pump before the water is heated by the dynamic heat generator. The prime mover can be an engine, a turbine, an electric motor, a hydraulic motor or a combination thereof. As will be described below in reference to FIG. 1, the system may also include: (1) a first filter connected between the pump and the one or more heat exchangers; (2) a second filter connected between the one or more heat exchangers and the output; (3) a solids separator connected between the pump and the one or more heat exchangers; (4) a second pump connected between the solids separator and the one or more heat exchangers; or (5) a second heat exchanger connected between the pump and the dynamic heat generator to transfer heat from the prime mover to the water before the water is heated by the dynamic heat generator. The first and second filters may include one or more carbon-based filters, one or more sand-based filters, one or more screens or a combination thereof The solids separator may include one or more filters, one or more screens, a hydrocyclone or a combination thereof The system can be portable.

Now referring to FIG. 1, a flameless hot water system 10 for killing pathogens and other contaminants, in accordance with a particular embodiment is shown. In system 10, water is pumped from a raw water supply 11 to a solids separator 14 using a pump 12. In particular embodiments, solids separator 14 may include one or more filters, one or more screens, a hydrocyclone or a combination thereof. For example, a hydrocyclone spins the received water within a chamber to force solids out in a centrifugal manner. In particular embodiments, solids separator 14 may filter out solids as small as three microns.

The clarified water exits the solids separator, or hydrocyclone, at the top of the separator and is pumped by pump 16 to a filter 18. Filter 18 may include any suitable filter type, such as one or more carbon-based filters, one or more sand-based filters, one or more screens or a combination thereof. Some embodiments may not include a filter 18 to which the water clarified at solids separator 14 is pumped.

After passing through filter 18, the water enters heat exchangers 20, 22 and 24 which add heat to the incoming water. Heat exchangers 20, 22 and 24 may include a plurality of pipes within a tube. Water flowing in the direction indicated by arrow 21 passes through the pipes and is heated by warmer water flowing 15 outside the pipes in the opposite direction.

After leaving heat exchanger 24, the water continues to heater 26 which includes a dynamic heat generator. The dynamic heat generator can heat the water any suitable amount (specified temperature) to kill pathogens and other contaminants. The difference in temperature between water coming into the dynamic heat generator and water leaving the dynamic heat generator may be modified by controlling the flow. For example, if the flow is restricted and the water stays within dynamic heat generator 26 longer, then the difference in temperature between incoming and outgoing water is greater. Similarly, if the flow rate increased, then the difference in temperature between incoming and outgoing water is lower.

In particular embodiments, the dynamic heat generator is approximately twelve inches in diameter and six inches in width. In some embodiments it is made of aluminum, although it can be constructed from other materials in other embodiments. In particular embodiments, the dynamic heat generator may be similar or identical to an Island City, LLC dynamic heat generator. The dynamic heat generator may consist of only two moving parts. Running an engine around 1800 RPMs spins the dynamic heat generator which causes internal wheels to rotate and compress the water molecules flowing therethrough, thereby causing friction that produces heat. The power source for the system can be an engine or electrical motor. In some embodiments, a sixty-six horse power diesel engine is used as the power source. Attached to the drive shaft of the engine is the dynamic heat generator.

In the illustrated embodiment, diesel engine 28 is used to drive heater 26. Diesel engine 28 includes heat exchanger 31 through which water is pumped by pump 30. Thus, heat produced by the work performed by diesel engine 28, for example in the engine jacket water, is used to heat water flowing into heat exchanger 21. Pump 30 pumps, to heat exchanger 31, the water that is used to heat the water flowing in the direction of arrow 21 in heat exchanger 22. Therefore, a loop is created to maximize use in the system of heat produced by the diesel engine.

After exiting the dynamic heat generator, the water flows in the direction of arrow 27 back through heat exchanger 24 (e.g., outside the pipes through which the incoming water flowing along direction 23 into heat exchanger 24 passes). This warmer water from the dynamic 30 heat generator that flows outside the pipes of heat exchanger 24 warms the water flowing into the heat exchanger. Thus, after pathogens and other contaminants are killed by the heating of the water by dynamic heat generator 26, the heat is recovered for use in heat exchanger 24 to add efficiency to the system.

After exiting heat exchanger 24, the water flows in the direction indicated by arrow 29 back to heat exchanger 20 to aid in warming the water entering heat exchanger 20 from filter 18. The water leaves heat exchanger 20 and flows to filter 32, check valve 34, gauge 36 and valve 38. In some cases, if filter 32 gets clogged for example, pressure may increase at check valve 40 such that the valve releases to allow the water to flow back into water supply 11. Filter 32 may be useful to remove harmful contaminants post-distillation, such as arsenic.

The flow of water exiting system 10 through valve 38 may be controlled. In some cases, the water may exit at approximately 15 gallons per minute. In some embodiments, system 10 may consume, as a rule of thumb, one gallon of fuel, per twenty horse power, per hour per 1,000 gallons of processed water. As indicated above, by controlling the water flow and the power driving the dynamic heat generator, the water flowing through the system may be heated to any suitable temperature to kill pathogens and other contaminants. For example, in some embodiments the water may be heated to 220 degrees Fahrenheit, and approximately 5 kW of electrical power may be generated.

When a distillation process is required, two steps in addition to those described with respect to FIG. 1 may be utilized. Rather than circulating water directly through dynamic heat generator 26, a heat transfer liquid may be run in a closed loop to generate the desired level of temperature. This heat transfer liquid is run through the inside of a heat exchanger and water is run through the outside of the heat exchanger. This step prevents potential damage to the seal in the dynamic heat generator due to abrasive properties from the salt water. The second modification is the addition of a second hydrocyclone. The heated water flows out of the heat exchanger and runs directly into the hydrocyclone. As the hot water spins in the hydrocyclone, a vacuum is created causing the water to flash to steam. The remaining "salt slurry" drops out of the bottom of the hydrocyclone into a holding tank. The steam may then run through a liquid separator into a holding tank.

For example, the present invention provides a system for desalinating saltwater using a prime mover (e.g., an engine, a turbine, an electric motor, a hydraulic motor or a combination thereof), a closed loop (dynamic heat generator, a first pump and a first heat exchanger), a second pump and a hydrocyclone. The dynamic heat generator is driven by the prime mover to heat a heat transfer liquid to a least the specified temperature without a flame. The first heat exchanger connected to the second pump such that such that the heated heat transfer liquid from the dynamic heat generator is used to heat the saltwater from the second pump. The hydrocyclone is connected to the first heat exchanger, receives the heated saltwater and substantially separates the heated saltwater into desalinated water and a salt slurry. The system may also include: (1) a source of saltwater connected to the second pump; (2) a first storage that receives the desalinated water; (3) a second storage that receives the salt slurry; (4) a second heat exchanger connected between the second pump and the first heat exchanger to transfer heat from the prime mover to the saltwater before the saltwater is heated by the first heat exchanger; or (5) a third heat exchanger connected between the hydrocyclone and the first storage to transfer heat from the desalinated water to the saltwater before the saltwater is heated by the first heat exchanger. The system can be portable.

Figure 2:
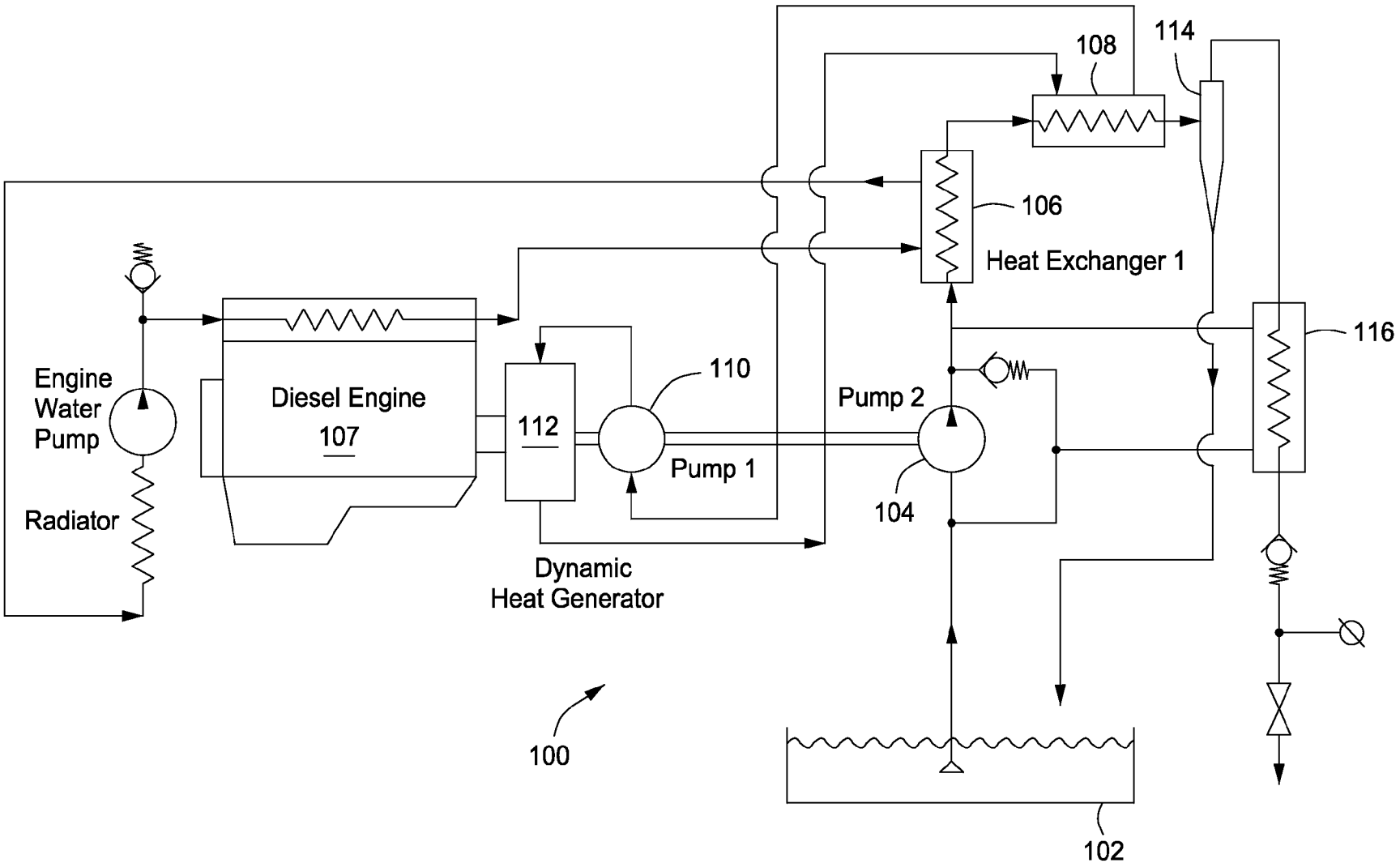
FIG. 2 illustrates a flameless hot water system for the distillation of salt water, in accordance with a particular embodiment

Referring now to FIG. 2, a flameless hot water system 100 for the distillation of salt water, in accordance with a particular embodiment is shown. Water is pumped from water source 102 using pump 104. The water flows through heat exchanger 106 for preheating. The outside of heat exchanger 106 (e.g., the heating element) may comprise water glycol from a diesel engine 107. The water may then flow through the inside of heat exchanger 108 for superheating (e.g., to at least 212 degrees Fahrenheit in some embodiments). The outside of heat exchanger 108 may comprise a heat transfer fluid (e.g., dynalene) circulated by pump 110 through dynamic heat generator 112 to reach a high temperature, such as approximately 300 degrees Fahrenheit.

The superheated water then flows into hydrocyclone 114 where a vacuum is created. At this point, the superheated water flashes to steam and escapes through the top of hydrocyclone 1 14. The water that does not flash to steam and the salt that has been separated in the flashing process will flow out of the bottom of hydrocyclone 114 to return to water source 102 or other capturing tanks as desired. The water that has flashed to steam flows through the inside of heat exchanger 116 to be cooled by ambient water such that it is condensed back to a purified liquid state.

In another example, the present invention provides a system for melting paraffin in an oil well using a prime mover (e.g., an engine, a turbine, an electric motor, a hydraulic motor or a combination thereof), a water or oil storage unit, a dynamic heat generator and a valve. The dynamic heat generator is driven by the prime mover and is connected to or disposed within the water or oil storage unit to heat the water to a least a specified temperature without a flame. The valve connects the dynamic heat generator to the water or oil storage unit and the oil well such that the heated water is circulated to the water storage until the heated water in the water storage reaches a temperature sufficient to melt the paraffin and the heated water is pumped into the oil well. The system may also include: (1) a heat exchanger connected between the pump and the dynamic heat generator to transfer heat from the prime mover to the water before the water is heated by the dynamic heat exchanger; or (2) a pump connected between the water or oil storage unit and the dynamic heat generator. The system can be portable.

Figure 3:
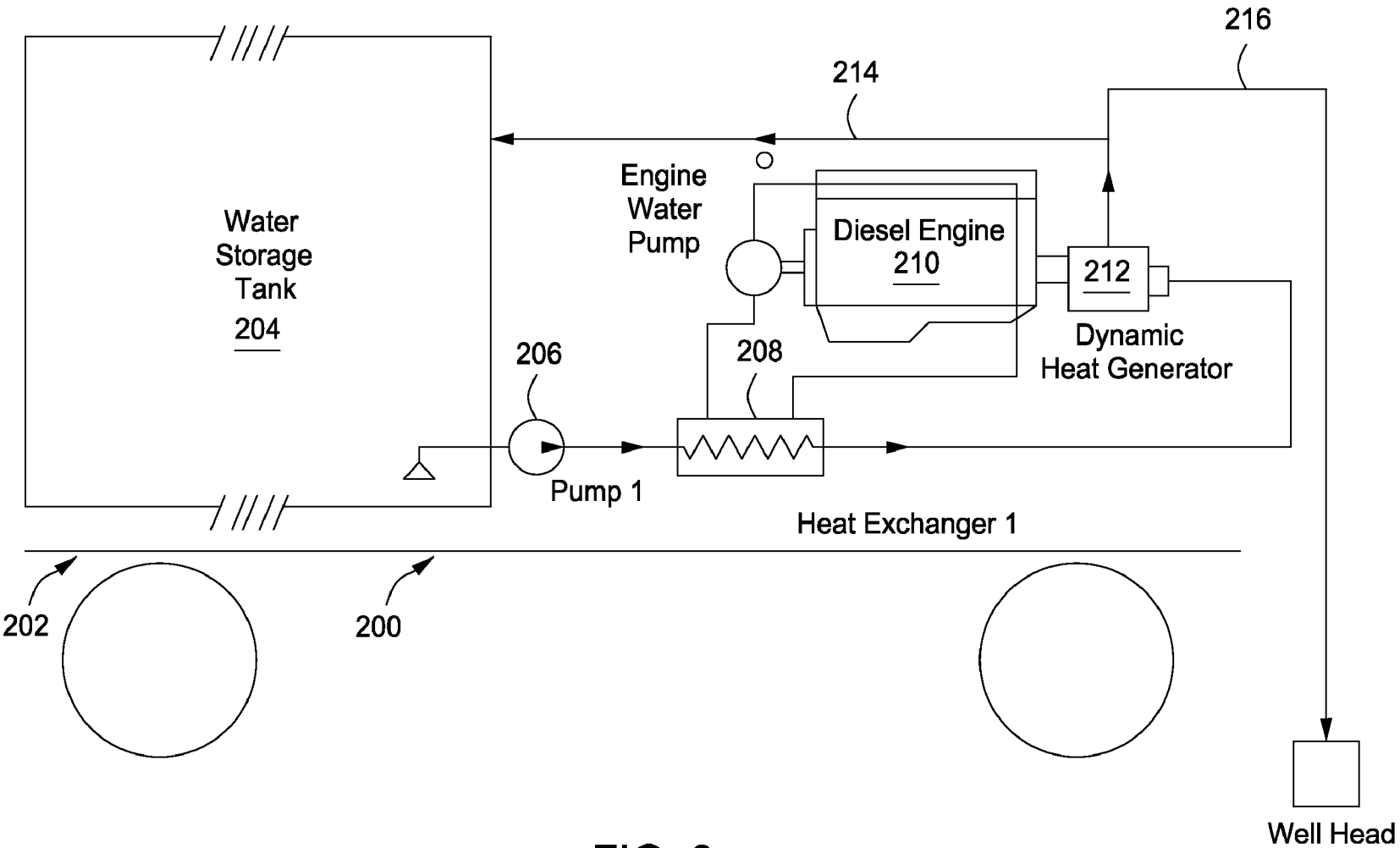
FIG. 3 illustrates a portable flameless hot water system for on site treatment of paraffin clogging used in the oil field service industry, in accordance with a particular embodiment.

Now referring to FIG. 3, a portable flameless hot water system 200 for on site treatment of paraffin clogging used in the oil field service industry, in accordance with a particular embodiment is shown. As a way of heating water high enough to melt down hole paraffin, a system has be designed to perform this function either on site or by mounting the system on a truck for mobility. For example, by mounting the system described in FIG. 1 on a truck and using water stored in a seventy-five barrel tank, a line is run from the water tank directly to the water heating system. As the water circulates through a dynamic heat generator, it is sent back to the water tank until the water reaches a temperature of 250 degrees Fahrenheit. Once that temperature is reached the water is then sent down hole through the well head for the paraffin melting process.

As illustrated, system 200 is mounted on truck 202 for mobility. Water is pumped using pump 206 from a baffled water storage tank 204 mounted on the truck bed. The water flows through the inside of heat exchanger 208 for preheating. As is the case in other embodiments, the preheating process increase's the efficiency of the system and takes advantage of otherwise unused energy. In particular embodiments, the outside of heat exchanger 208 may comprise water glycol from the cooling system of engine 210. The water then flows through dynamic heat generator 212 for superheating. The water is then piped back into water storage tank 204 (e.g., along piping 214). The process continues in a loop fashion until the water in storage tank 204 reaches a certain desired temperature (e.g., approximately 212 or 250 degrees Fahrenheit in some embodiments). At this point, the super hot water is released along line 216 directly into the well head and down the perforation where the paraffin is treated.

Figure 4:
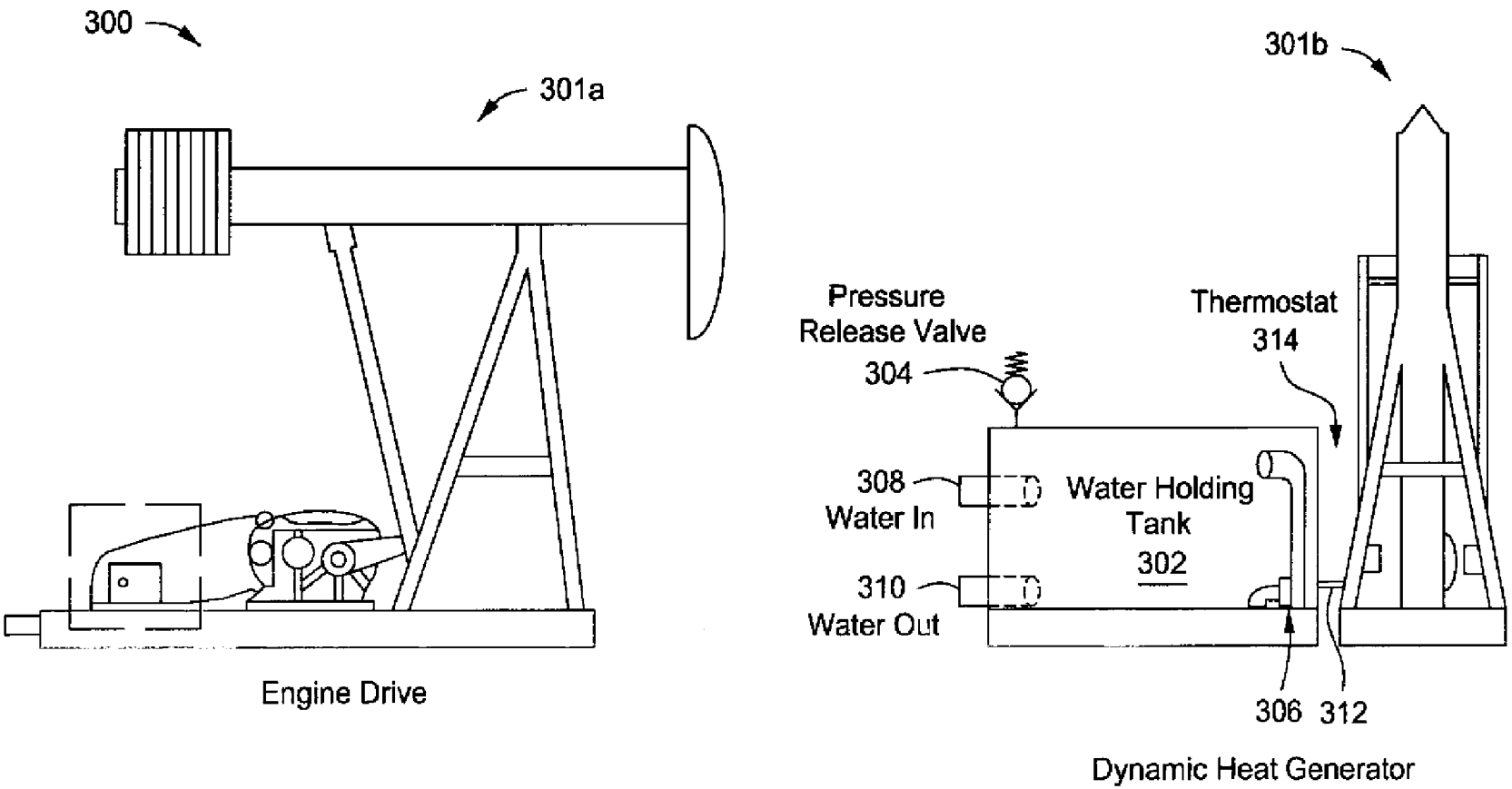
FIG. 4 illustrates a permanent on site flameless hot water system for paraffin clogging used in the oil field service industry, in accordance with a particular embodiment.

Referring now to FIG. 4, a permanent on site flameless hot water system 300 for paraffin clogging used in the oil field service industry, in accordance with a particular embodiment is shown. FIG. 4 includes a side view 301*a* and an end view 301*b* of system 300. Water is stored next to the well head in a sealed steel pressure vessel 302 with a pressure release valve 304. A dynamic heat generator 306 may be installed inside sealed steel vessel 302 with an input pipe 308 and an exit pipe 310 attached 20 to allow for the flow of water. A drive shaft 312 is extended from the pump jack electrical motor to dynamic heat generator 306.

When the pump jack has completed its time cycle to pump oil, the electric motor turns off. Operated by a timer, the electric motor reverses its rotation and becomes the power source for dynamic heat generator 306 by way of an overrunning clutch and drive shaft. The overrunning clutch mounted under the pump jacks sheave prevents the pump jack from operating thus allowing the electric motor to be used as the power source for spinning dynamic heat generator 306. Water is circulated in steel vessel 302 until it reaches a desired temperature, such as approximately 250 degrees Fahrenheit. At this time, a thermostat 314 releases the hot water back down hole allowing the hot water to clean the perforation holes that are clogged with paraffin. In particular embodiments, this process may be done without any flames.

Figure 5:
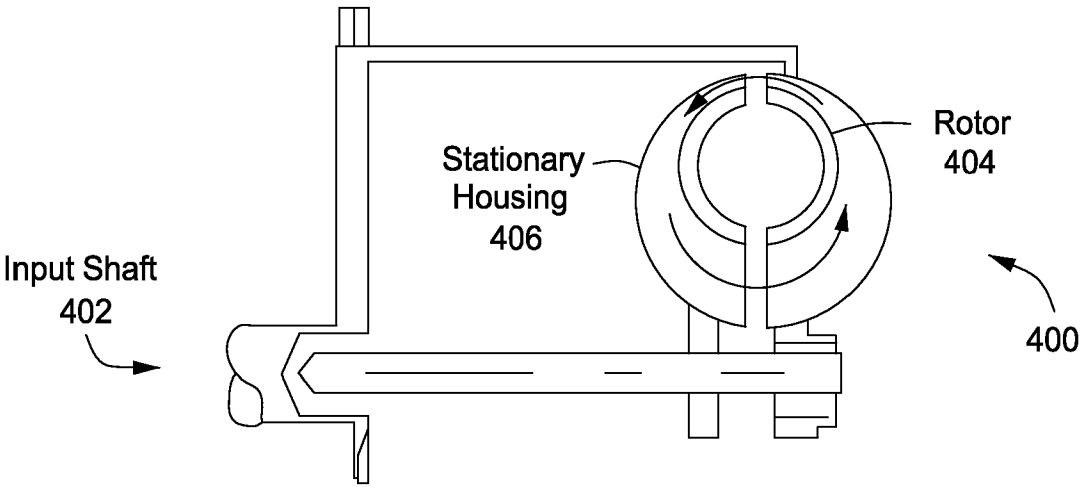
FIG. 5 illustrates an example dynamic heat generator for use in various applications, in accordance with a particular embodiment.

Now referring to FIG. 5, an example dynamic heat generator 400 for use in various applications, in accordance with a particular embodiment is illustrated. For example, dynamic heat generator 400 may be used as the dynamic heat generator of various applications described herein. Dynamic heat generator 400 is a hydrodynamic device that takes rotational energy provided by a prime mover (diesel engine, electric motor, hydraulic motor, etc.) from a relatively low velocity near its center to a high velocity at its outer diameter creating kinetic energy (heat) in the fluid.

Power, created by the prime mover, is absorbed following basic laws of centrifugal pumps. For example, power capacity is proportional to the input speed to the third power, and power capacity is proportional to the rotors diameter to the fifth power.

Structurally, dynamic heat generator comprises a rotor 404 with radial vanes and a stationary housing 406 with matching radial vanes. Fluid enters dynamic heat generator 400 at an input shaft 402. As rotor 404 turns, the fluid carried by the blades is under the influence of various tangential forces. A fluid head is created which transfers the liquid from the rotor 404 vanes to the vanes in stationary housing 406. The result is the fluid flowing at a maximum velocity and the creation of kinetic energy (heat).

In operation, working fluids are pumped into dynamic heat generator 400 where the fluid is effectively heated through hydrodynamic action and is then provided as a feedstock for a variety of process requirements such as water purification and distillation.

Various applications of particular embodiments may include heating water in excess of 212 degrees Fahrenheit to kill pathogens, flashing hot water to steam for desalination of contaminated or salt water, generating on board potable water from a vehicle's air brakes, exhausts, air condition condensation or external opportunistic water sources, producing radiant heat in pipes for habitat heating, melting ice and snow, heating portable showers, cooking, de-icing aircraft, heating hot tubs and swimming pools, steam reforming of petroleum fuels for production of hydrogen use in fuel cells for hybrid vehicles, melting paraffin in down hole tubing, and heating water for carwashes and home appliances (dishwashers, hot water heaters, washing machines).

Figure 6:
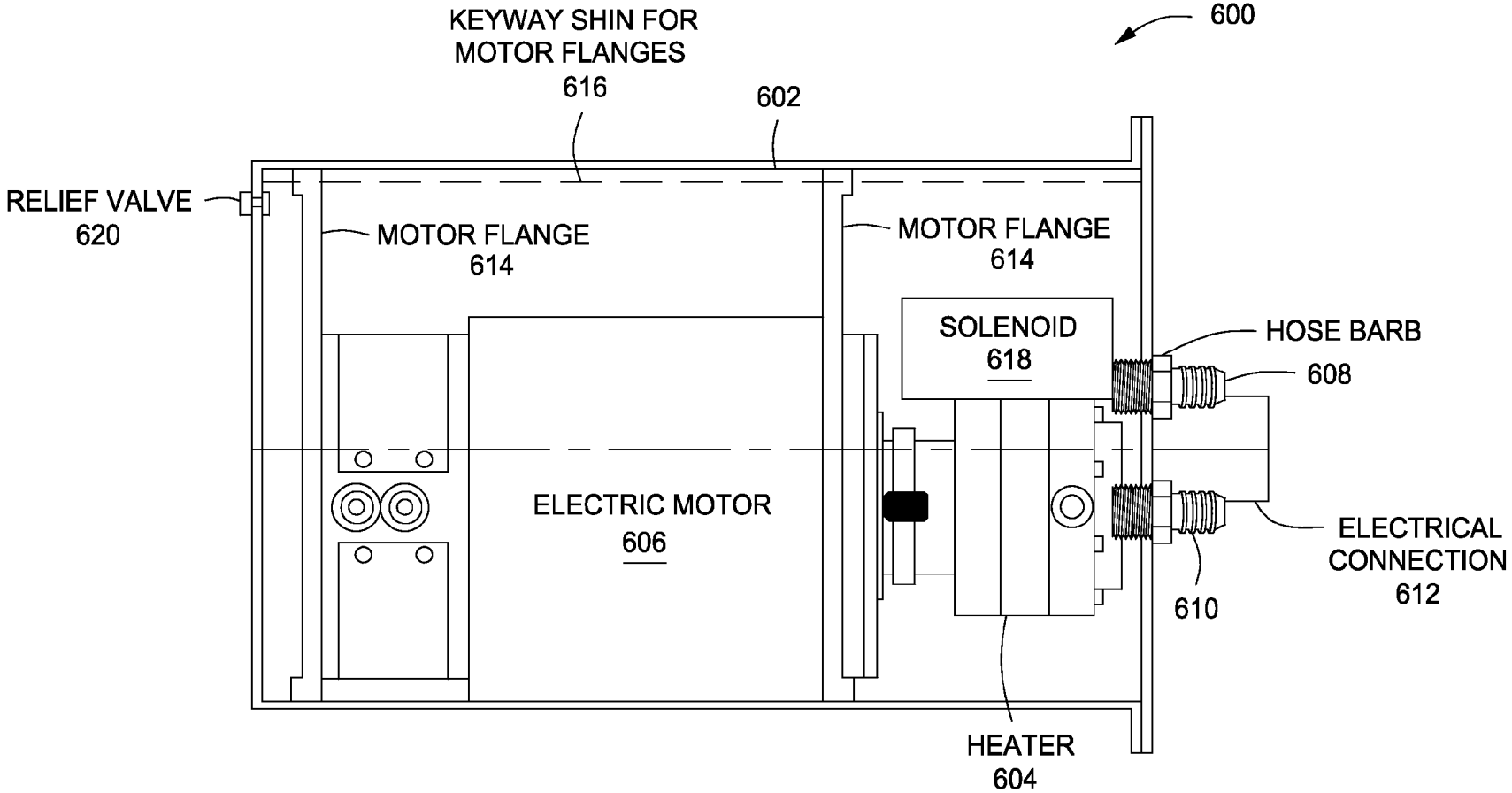
FIG. 6 illustrates a modular heater in accordance with one embodiment of the present invention.

Referring now to FIG. 6, a modular heater 600 in accordance with one embodiment of the present invention is illustrated. The modular heater 600 includes an enclosure 602, a dynamic heat generator 604 disposed within the enclosure 602, an electric motor 606 disposed within the enclosure, a first fluid connector 608 attached to the enclosure 602, a second fluid connector 610 attached to the enclosure 602 and an electrical connector 612 attached to the enclosure 602. The electric motor 606 drives the dynamic heat generator 604 to heat the fluid to a specified temperature without a flame. The first fluid connector 608 connects the dynamic heat generator 604 to a fluid source (not shown). The second fluid connector 610 connects the dynamic heat generator 604 to a fluid storage (not shown). The electrical connector 612 connects the electric motor 606 to a power source (not shown). As shown, the modular heater 600 also includes motor flanges 614 attached to each end of the motor 606 to secure the motor 606 within the enclosure 602 via keyway shims 616, a solenoid 618 to turn the electric motor 606 on and off, and a relief value 620 attached to the enclosure 602 to prevent an excessive pressure build up from occurring within the enclosure 602.

The modular heater 600 is completely self-contained and can be quickly installed for cold weather conditions. This cylindrical module 600 can be installed in a permanent system, portable system or a vehicle via a quick-connect coupling system (i.e., the first fluid connector 608, the second fluid connector 610 and the electrical connector 612). The coupling system is asymmetrical and makes use of two guide pins to ensure quick and proper installation under all climatic conditions. Installation is completed by moving a single lever to the "locked" position.

Alternatively, the modular heater 600 can be modified such that the power source and the electrical connector 612 are disposed with the enclosure 602. Similarly, a pump can be disposed within the enclosure 602 and connected between the first fluid connector 608 and the dynamic heat generator 604. Furthermore, a controller electrically connected to the electric motor 606 can be disposed within or attached to the enclosure 602.

Note that the modular heater 600 can be used as in the systems previously described in reference to FIGS. 1-4. The modular heater 600 can be used to heat the fluid to a specified temperature that is:

a range of temperatures between a minimum temperature and a maximum temperature;

greater than or equal to 212 degrees Fahrenheit;

greater than a temperature required to kill pathogens within the fluid;

greater than or equal to 250 degrees Fahrenheit;

greater than or equal to 300 degrees Fahrenheit;

greater than or equal to a temperature required to desalinate saltwater;

greater than or equal to a temperature required to melt paraffin;

greater than or equal to a temperature required to create steam;

greater than or equal to a temperature required to preheat an engine;

greater than or equal to a temperature required to heat a crew area of a vehicle; or greater than or equal to a temperature required to heat a cargo area of a vehicle.

As a result, the heated fluid can be used to produce electricity, provide radiant heat, provide drinking water, melt paraffin in an oil well, produce steam, produce steam to reform a petroleum fuel to produce hydrogen for use in a fuel cell, preheat an engine, heat a crew area of a vehicle, or heat a cargo area of a vehicle.

Figure 7:
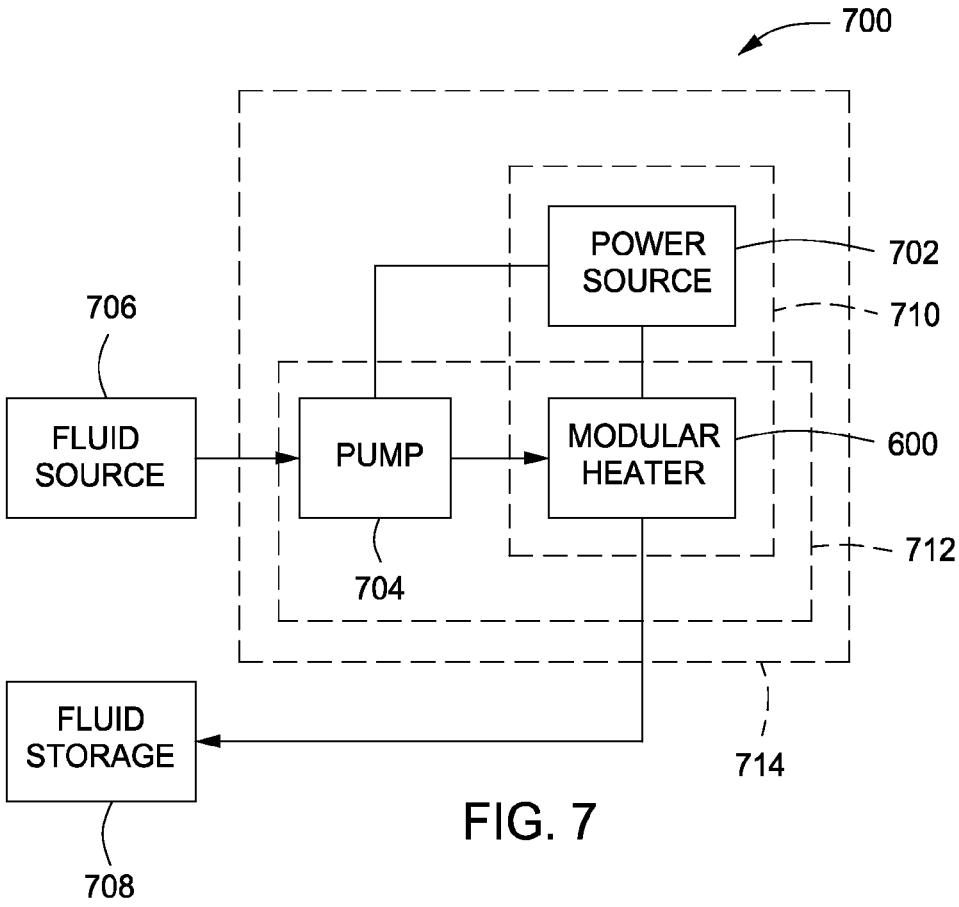
FIG. 7 is a block diagram of a heater system using a modular heater in accordance with one embodiment of the present invention.

Now referring to FIG. 7, a block diagram of a heater system 700 using a modular heater 600 in accordance with one embodiment of the present invention is shown. The system 700 includes a modular heater 600, a power source 702 electrically connected to an electric motor 606 and a pump 704 connected to a dynamic heat generator 604. As shown in FIG. 6, the modular heater 600 includes the dynamic heat generator 604 driven by the electric motor 606 disposed within an enclosure 602. The dynamic heat generator 604 is driven by the electric motor 606 to heat the fluid to a least the specified temperature without a flame. The pump 704 is connected to a fluid source 706. The dynamic heat generator 604 of the modular heater 600 is connected to a fluid storage 708. As previously described, the modular heater 600 can be modified to also include the power source 702 as illustrated by dashed line 710, the pump 704 as illustrated by dashed line 712 or both the power source 702 and pump 704 as illustrated by dashed line 714.

Figure 8:
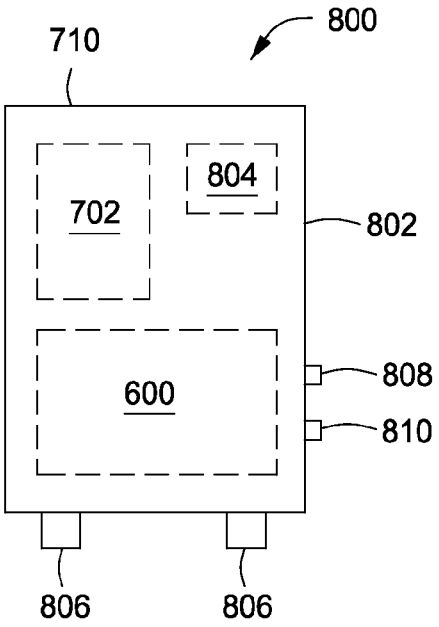
FIG. 8 is a block diagram of a portable heater system in accordance with one embodiment of the present invention.

Referring now to FIG. 8, a block diagram of a portable heater system 800 in accordance with one embodiment of the present invention is shown. The portable heater system 800 (see also system 710) is a frame or enclosure 802 in which a modular heater 600, a power source 702 and a controller 804 are physically connected and made portable via wheels or skids 806. Fluid input connector 808 and output connector 810 are also physically connected to the frame or enclosure 802 so that the system 800 can be quickly connected or disconnected to a fluid source and fluid output.

Figure 9:
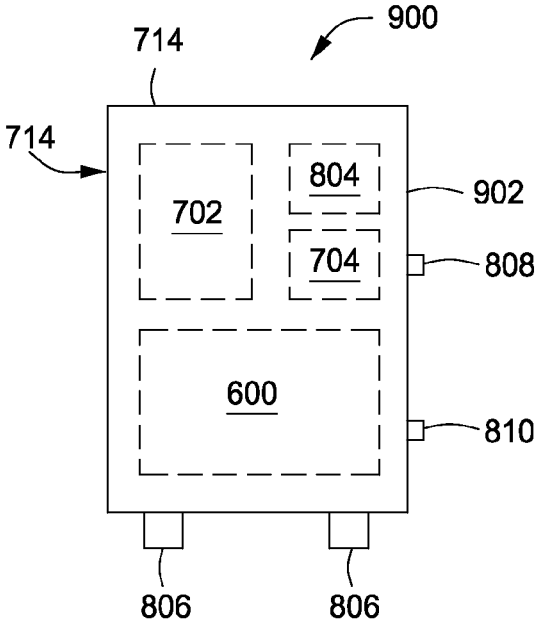
FIG. 9 is a block diagram of a portable heater system in accordance with one embodiment of the present invention.

Now referring to FIG. 9, a block diagram of a portable heater system 900 in accordance with one embodiment of the present invention is shown. The portable heater system 900 (see also system 714) is a frame or enclosure 902 in which a modular heater 600, a power source 702, a pump 704 and a controller 804 are physically connected and made portable via wheels or skids 806. Fluid input connector 808 and output connector 810 are also physically connected to the frame or enclosure 802 so that the system 800 can be quickly connected or disconnected to a fluid source and fluid output.

Figure 10:
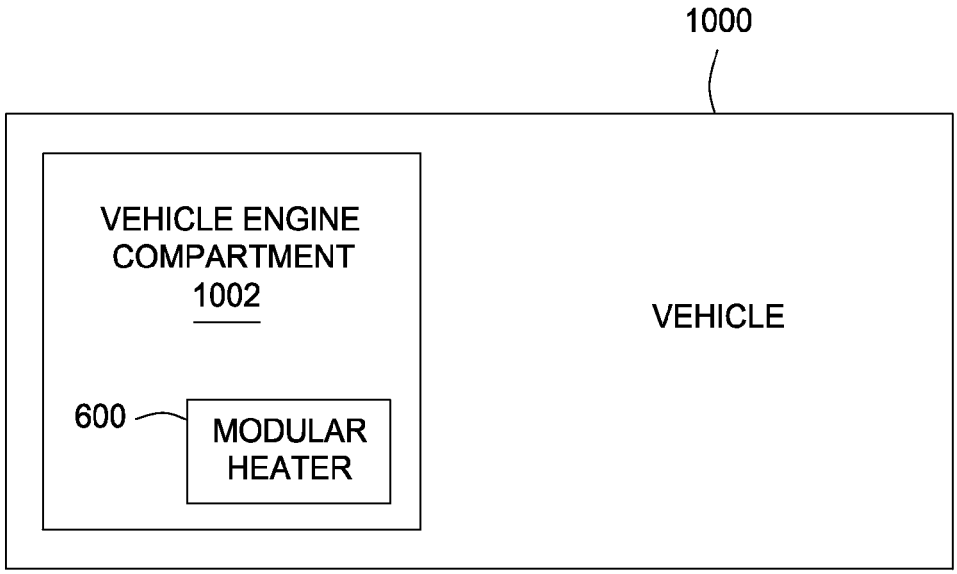
FIG. 10 is a block diagram of a vehicle having a modular heater in accordance with one embodiment of the present invention.

Referring now to FIG. 10, a block diagram of a vehicle 1000 having a modular heater 600 in accordance with one embodiment of the present invention is shown. The modular heater 600 is removeably installed in the engine compartment 1002 of the vehicle 1000. The modular heater 600 is completely self-contained and can be quickly installed for cold weather conditions. As previously described, this cylindrical module is installed to the vehicle via a quick-connect coupling system. The coupling is asymmetrical and makes use of two guide pins to ensure quick and proper installation under all climatic conditions. Installation is completed by moving a single lever to the "locked" position. Locking the module in connects it to the engine's water/glycol coolant system as well as the vehicle's 28 VDC power grid.

Figure 11:
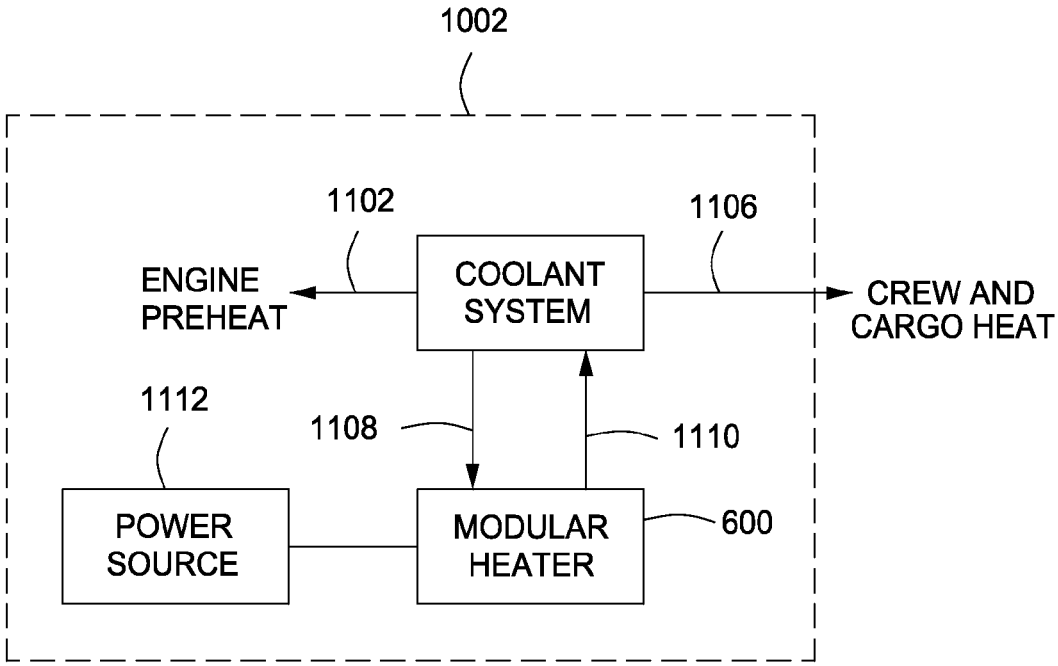
FIG. 11 is a block diagram of a modular heater used in a vehicle in accordance with one embodiment of the present invention.

Referring now to FIG. 11, a block diagram of a modular heater 600 used in a vehicle engine compartment 1002 in accordance with one embodiment of the present invention is shown. In operation, water/glycol is circulated (shown by arrow 1102) by the engine's water pump to the engine, radiator and thermostat (collectively the coolant system 1104) in a normal fashion. But now a portion of the mixture that is normally destined for the vehicle's cab heater and defroster (shown by arrow 1106) is diverted to the modular heater 600 (shown by arrow 1108). Controlled by the engine's COTS (thermostat system), if the water mixture is less than or equal to a preset temperature it closes its electrical contact. Closing these contacts sends an electrical signal to a high capacity solenoid 618 mounted inside the module 600 next to the DC electric motor 606. The high capacity solenoid 618 is connected to power source (battery) 1112. The motor 606 then starts, turning the dynamic heat generator 604, and causing more of the water mixture to be drawn from the engine cooling loop 1108 and to be heated within the module 600. The heated water 1110 then flows to the cabin heater and defroster 1106 on the engine to complete the loop. The heater module 600 will continue to operate until the water flowing reaches a preset temperature at which time it will switch off. Vehicle/engine pre-heating can be accomplished by electrically "slaving" the vehicle from either another vehicle or external power source such as a Genset or utility power (any of which are also shown as power source 1112). During this pre-heating all vehicle systems are brought up to optimum operating temperature and are automatically maintained for maximum efficiency. During mobile operations in cold temperatures, the heater maintains the optimum engine/coolant temperature regardless of engine loading, thereby ensuring not only the comfort of the passengers by also maximum vehicle performance and mobility.

Figure 12:
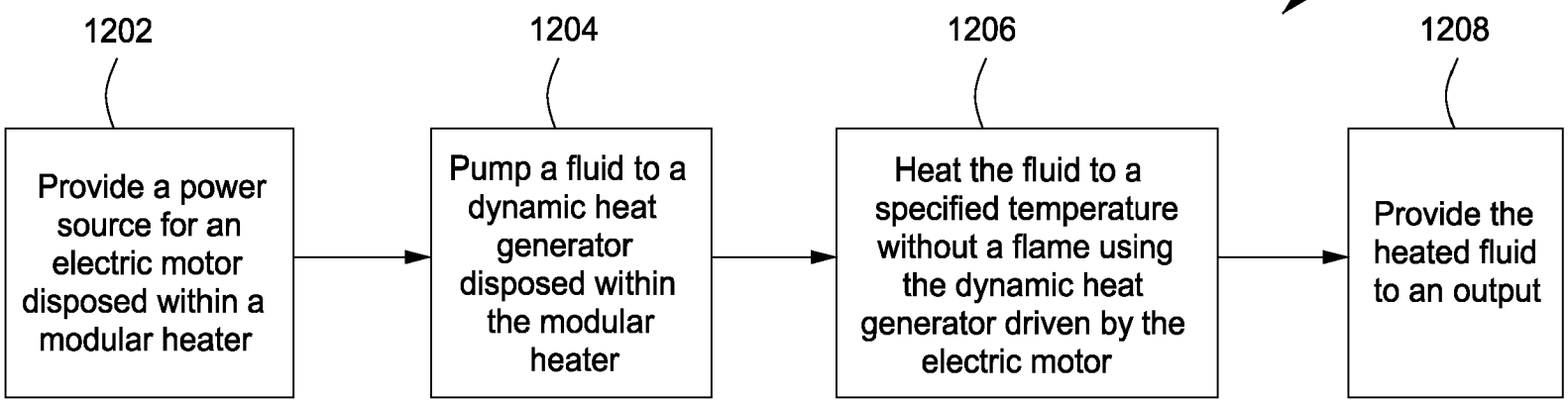
FIG. 12 is a flow chart illustrating a method of heating a fluid in accordance with one embodiment of the present invention.

Now referring to FIG. 12, a flow chart illustrating a method 1200 of heating a fluid in accordance with one embodiment of the present invention is shown. A power source for the electric motor 606 disposed with the modular heater 600 is provided in block 1202. The fluid is pumped to the dynamic heat generator 604 disposed within the modular heater 600 in block 1204. The fluid is then heated to a specified temperature without a flame using the dynamic heat generator 604 driven by the electric motor 606 in block 1206 and the heated fluid is provided to an output in block 1208. Note that this method 1200 can be used in any of the systems previously described in reference to FIGS. 1-4 and 7-10. In addition, the specified temperature can be controlled by adjusting a flow rate of the fluid through the dynamic heat generator 604 or varying a speed of the electric motor 606 if the electric motor 606 is a variable speed motor.

Figure 13:
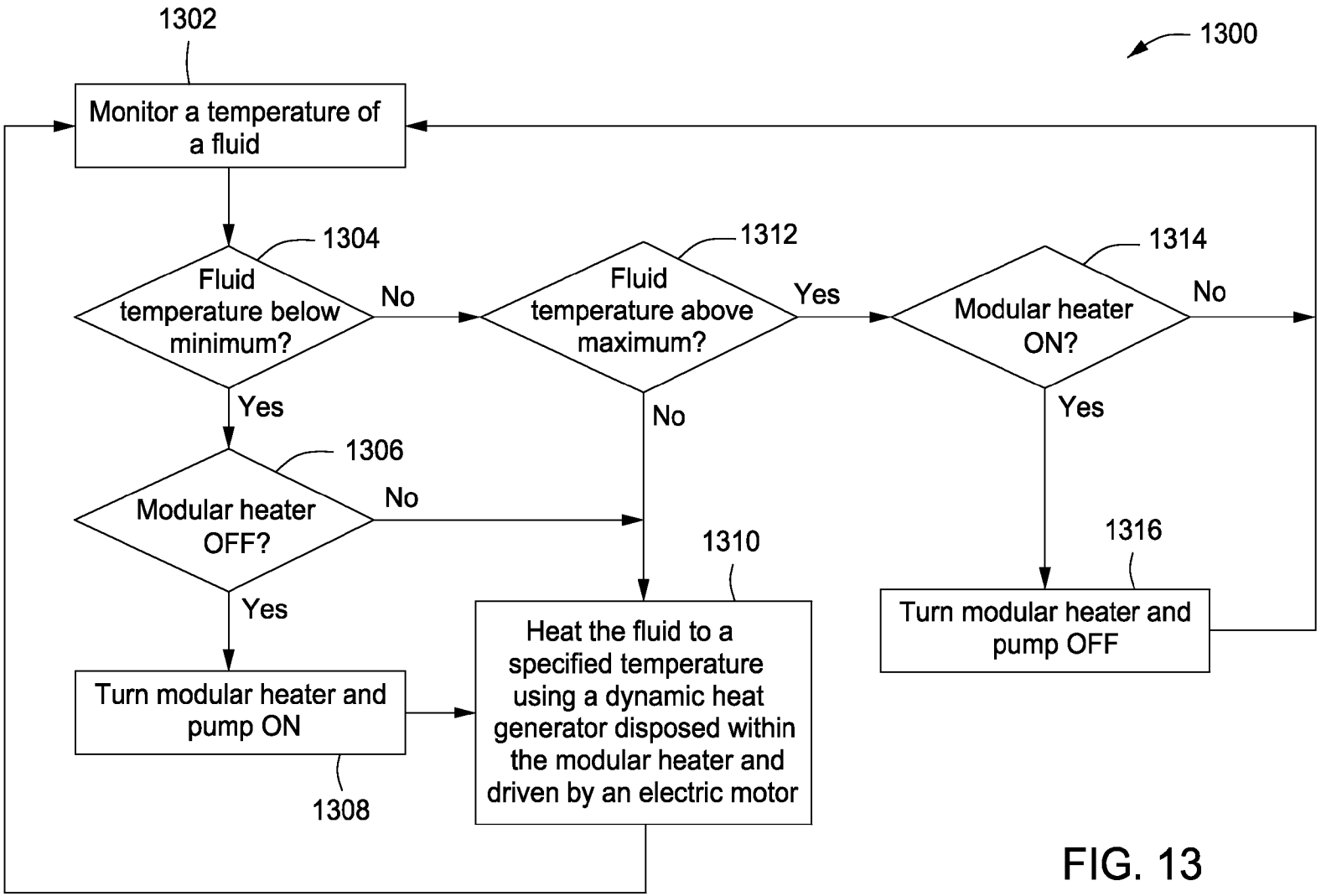
FIG. 13 is a flow chart illustrating a method of heating a fluid in accordance with another embodiment of the present invention.

Referring now to FIG. 13, a flow chart illustrating a method 1300 of heating a fluid in accordance with another embodiment of the present invention is shown. A temperature of a fluid is monitored in block 1302. If the fluid temperature is below a minimum temperature, as determined in decision block 1304, and the modular heater is off, as determined in decision block 1306, the modular heater is turned on in block 1308, the fluid is heated to a specified temperature without a flame using the dynamic heat generator 604 driven by the electric motor 606 in block 1310, and the fluid temperature is monitored in block 1302. If, however, the modular heater is not off, as determined in decision block 1306, the fluid is heated to a specified temperature without a flame using the dynamic heat generator 604 driven by the electric motor 606 in block 1310, and the fluid temperature is monitored in block 1302. If, however, the fluid temperature is not below the minimum temperature, as determined in decision block 1304, and the fluid temperature is not above a maximum temperature, as determined in decision block 1312, the fluid is heated to a specified temperature without a flame using the dynamic heat generator 604 driven by the electric motor 606 in block 1310, and the fluid temperature is monitored in block 1302. If, however, the fluid temperature is above the maximum temperature, as determined in decision block 1312, and the modular heater is on, as determined in decision block 1314, the modular heater is turned off in block 1316, and the fluid temperature is monitored in block 1302. If, however, the modular heater is not on, as determined in decision block 1314, the fluid temperature is monitored in block 1302. Note that this method 1300 can be used in any of the systems previously described in reference to FIGS. 1-4 and 7-10. In addition, the specified temperature can be controlled by adjusting a flow rate of the fluid through the dynamic heat generator 604 or varying a speed of the electric motor 606 if the electric motor 606 is a variable speed motor.

Although the present invention has been described in detail with reference to particular embodiments, it should be understood that various other changes, substitutions, and alterations may be made hereto without departing from the spirit and scope of the present invention. For example, although the present invention has been described with reference to a number of components included within various systems, these components may be combined, rearranged, re-sized or positioned in order to accommodate particular needs and applications. The present invention contemplates great flexibility in the arrangement of these elements as well as their internal components.

For example, some embodiments may utilize an engine or mechanism other than a diesel engine to drive the dynamic heat generator. Depending on particular needs and applications, particular embodiments may not utilize one or more components such as one or more of the illustrated heat exchangers, filters and pumps. Numerous other changes, substitutions, variations, alterations and modifications may be ascertained by those skilled in the art and it is intended that the present invention encompass all such changes, substitutions, variations, alterations and modifications as falling within the spirit and scope of the appended claims.

What is claimed is:

1. A method for heating a fluid without a flame comprising the steps of:

providing a modular heater comprising an enclosure, a dynamic heat generator disposed within the enclosure, an electric motor disposed within the enclosure and connected to the dynamic heat generator, a controller disposed within the enclosure;

providing a power source for an electric motor disposed within a modular heater;

pumping the fluid to a dynamic heat generator disposed within the modular heater;

heating the fluid to a specified temperature without the flame using the dynamic heat generator driven by the electric motor, wherein the electric motor drives two or more internal wheels within the dynamic heat generator to rotate and compress the fluid causing friction that heats the fluid passing through the dynamic heat generator, and the specified temperature is controlled by adjusting a flow rate of the fluid through the dynamic heat generator; and providing the heated fluid to an output.

2. The method as recited in claim 1, further comprising the step of substantially removing solids from the fluid.

3. The method as recited in claim 2, wherein the step of substantially removing solids from the fluid is performed with one or more filters, one or more screens, a hydrocyclone or a combination thereof.

4. The method as recited in claim 1, further comprising the step of pre-heating the fluid before the fluid is heated by the dynamic heat generator.

5. The method as recited in claim 1, further comprising the step of filtering the fluid before the fluid is heated by the dynamic heat generator.

6. The method as recited in claim 1, further comprising the steps of:

monitoring a temperature of the fluid;

turning the electric motor on whenever the temperature is below a minimum temperature; and turning the electric motor off whenever the temperature is above a maximum temperature.

7. The method as recited in claim 1, wherein the specified temperature is a range of temperatures between a minimum temperature and a maximum temperature, or is greater than or equal to 212 degrees Fahrenheit, or is greater than a temperature required to kill pathogens within the fluid, or is greater than or equal to 250 degrees Fahrenheit, or is greater than or equal to 300 degrees Fahrenheit, or is greater than or equal to a temperature required to desalinate saltwater, or is greater than or equal to a temperature required to melt paraffin, is greater than or equal to a temperature required to create steam, or is greater than or equal to a temperature required to preheat an engine, or is greater than or equal to a temperature required to heat a crew area of a vehicle, or is greater than or equal to a temperature required to heat a cargo area of a vehicle.

8. The method as recited in claim 1, wherein the flow rate of the fluid through the dynamic heat generator is adjusted by controlling the pump or a valve between the pump and the dynamic heat generator.

9. The method as recited in claim 1, wherein the electric motor is a variable speed motor and the flow rate of the fluid through the dynamic heat generator is adjusted by varying a speed of the variable speed motor.

10. The method as recited in claim 1, further comprising the step of using the heated fluid to produce electricity, provide radiant heat, provide drinking water, melt paraffin in an oil well, produce steam, produce steam to reform a petroleum fuel to produce hydrogen for use in a fuel cell, preheat an engine, heat a crew area of a vehicle, or heat a cargo area of a vehicle.

11. The method as recited in claim 1, further comprising the step of storing or circulating the heated fluid.

12. The method as recited in claim 1, wherein the modular heater comprises:

an enclosure having the dynamic heat generator and the electric motor disposed therein;

a first fluid connector attached to the enclosure to connect the dynamic heat generator to a fluid source;

a second fluid connector attached to the enclosure to connect the dynamic heat generator to the output; and an electrical connector attached to the enclosure to connect the electric motor to a power source.

13. A system for heating a fluid to at least a specified temperature without a flame comprising:

a modular heater comprising a dynamic heat generator driven by an electric motor disposed within an enclosure wherein the dynamic heat generator is driven by the electric motor to heat the fluid to a least the specified temperature without a flame, wherein the electric motor drives two or more internal wheels within the dynamic heat generator to rotate and compress the fluid causing friction that heats the fluid passing through the dynamic heat generator, and the specified temperature is controlled by adjusting a flow rate of the fluid entering the dynamic heat generator and/or a speed of the electric motor;

a power source electrically connected to the electric motor; and a pump connected to the dynamic heat generator.

14. The system as recited in claim 13, wherein the specified temperature is a range of temperatures between a minimum temperature and a maximum temperature, or is greater than or equal to 212 degrees Fahrenheit, or is greater than a temperature required to kill pathogens within the fluid, or is greater than or equal to 250 degrees Fahrenheit, or is greater than or equal to 300 degrees Fahrenheit, or is greater than or equal to a temperature required to desalinate saltwater, or is greater than or equal to a temperature required to melt paraffin, is greater than or equal to a temperature required to create steam, or is greater than or equal to a temperature required to preheat an engine, or is greater than or equal to a temperature required to heat a crew area of a vehicle, or is greater than or equal to a temperature required to heat a cargo area of a vehicle.

15. The system as recited in claim 13, wherein the pump is connected to a fluid source.

16. The system as recited in claim 13, further comprising:

one or more heat exchangers connected to the pump and the dynamic heat generator such that the heated fluid from the dynamic heat generator is provided to an output and is used to pre-heat the fluid from the pump before the fluid is heated by the dynamic heat generator; and first filter connected between the pump and the one or more heat exchangers or a second filter connected between the one or more heat exchangers and the output.

17. The system as recited in claim 16, wherein the first and second filters comprise one or more carbon-based filters, one or more sand-based filters, one or more screens or a combination thereof.

18. The system as recited in claim 16, further comprising a solids separator connected between the pump and the one or more heat exchangers.

19. The system as recited in claim 18, wherein the solids separator comprises one or more filters, one or more screens, a hydrocyclone or a combination thereof.

20. The system as recited in claim 18, further comprising a second pump connected between the solids separator and the one or more heat exchangers.

21. The system as recited in claim 16, further comprising a second heat exchanger connected between the pump and the dynamic heat generator to transfer heat from a prime mover to the fluid before the fluid is heated by the dynamic heat generator.

22. The system as recited in claim 13, wherein the heated fluid is used to produce electricity, provide radiant heat, provide drinking water, melt paraffin in an oil well, produce steam, produce steam to reform a petroleum fuel to produce hydrogen for use in a fuel cell, preheat an engine, heat a crew area of a vehicle, or heat a cargo area of a vehicle.

23. The system as recited in claim 13, wherein the system is portable.

24. The system as recited in claim 13, wherein the dynamic heat generator comprises:

a stationary housing having an input, an output, and a first set of radial vanes within the stationary housing; and a rotor disposed within the stationary housing having a second set of radial vanes.

25. The system as recited in claim 13, wherein the modular heater comprises:

an enclosure having the dynamic heat generator and the electric motor disposed therein;

a first fluid connector attached to the enclosure to connect the dynamic heat generator to the pump;

a second fluid connector attached to the enclosure to connect the dynamic heat generator to an output; and an electrical connector attached to the enclosure to connect the electric motor to the power source.

26. A modular heater comprising:

an enclosure;

a dynamic heat generator disposed within the enclosure to heat a fluid to a specified temperature without a flame;

an electric motor disposed within the enclosure to drive the dynamic heat generator, wherein the electric motor drives two or more internal wheels within the dynamic heat generator to rotate and compress the fluid causing friction that heats the fluid passing through the dynamic heat generator, and the specified temperature is controlled by adjusting a flow rate of the fluid entering the dynamic heat generator and/or a speed of the electric motor;

a first fluid connector attached to the enclosure to connect the dynamic heat generator to a fluid source;

a second fluid connector attached to the enclosure to connect the dynamic heat generator to a fluid storage; and an electrical connector attached to the enclosure to connect the electric motor to a power source.

27. The modular heater as recited in claim 26, wherein the power source and the electrical connector are disposed with the enclosure.

28. The modular heater as recited in claim 26, further comprising a pump disposed within the enclosure and connected between the first fluid connector and the dynamic heat generator.

29. The modular heater as recited in claim 26, wherein the first fluid connector, the second fluid connector and the electrical connector comprise a quick-connect system.

30. The modular heater as recited in claim 26, further comprising a controller electrically connected to the electric motor and disposed within or attached to the enclosure.

31. The modular heater as recited in claim 26, wherein the specified temperature is a range of temperatures between a minimum temperature and a maximum temperature, or is greater than or equal to 212 degrees Fahrenheit, or is greater than a temperature required to kill pathogens within the fluid, or is greater than or equal to 250 degrees Fahrenheit, or is greater than or equal to 300 degrees Fahrenheit, or is greater than or equal to a temperature required to desalinate saltwater, or is greater than or equal to a temperature required to melt paraffin, is greater than or equal to a temperature required to create steam, or is greater than or equal to a temperature required to preheat an engine, or is greater than or equal to a temperature required to heat a crew area of a vehicle, or is greater than or equal to a temperature required to heat a cargo area of a vehicle.

32. The modular heater as recited in claim 26, wherein the heated fluid is used to produce electricity, provide radiant heat, provide drinking water, melt paraffin in an oil well, produce steam, produce steam to reform a petroleum fuel to produce hydrogen for use in a fuel cell, preheat an engine, heat a crew area of a vehicle, or heat a cargo area of a vehicle.

33. The modular heater as recited in claim 26, wherein the modular heater is portable.

34. The modular heater as recited in claim 26, wherein the dynamic heat generator comprises:

a stationary housing having an input, an output, and a first set of radial vanes within the stationary housing; and a rotor disposed within the stationary housing having a second set of radial vanes.

* * * * *